US008312966B1

(12) United States Patent
Guthrie et al.

(10) Patent No.: US 8,312,966 B1
(45) Date of Patent: Nov. 20, 2012

(54) BEAM ANCHOR

(76) Inventors: Karl Guthrie, Austin, TX (US); Joseph Schwartz, Wimberley, TX (US)

( * ) Notice: Subject to any disclaimer, the term of this patent is extended or adjusted under 35 U.S.C. 154(b) by 516 days.

(21) Appl. No.: 12/586,582

(22) Filed: Sep. 23, 2009

(51) Int. Cl.
*E04G 3/28* (2006.01)

(52) U.S. Cl. ..... 182/36; 182/3; 248/228.1; 248/228.3

(58) Field of Classification Search ..... 248/228.6, 248/228.5, 228.1, 228.2, 228.3, 228.4, 228.7, 248/72, 58, 62; 182/36, 3; 52/DIG. 11
See application file for complete search history.

(56) References Cited

U.S. PATENT DOCUMENTS

| | | | | | |
|---|---|---|---|---|---|
| 1,182,702 | A * | 5/1916 | Niles | 248/297.21 |
| 1,275,053 | A * | 8/1918 | Leiding | 52/37 |
| 2,182,057 | A * | 12/1939 | Chicoine et al. | 105/144 |
| 3,217,833 | A * | 11/1965 | Smith | 182/3 |
| 3,292,888 | A * | 12/1966 | Fischer | 248/72 |
| 3,394,776 | A * | 7/1968 | Abrams | 182/36 |
| 4,037,824 | A * | 7/1977 | Whitmer | 256/53 |
| 4,052,028 | A * | 10/1977 | Cordero, Jr. | 248/228.1 |
| 4,085,818 | A * | 4/1978 | Swager | 182/48 |
| 4,606,430 | A * | 8/1986 | Roby et al. | 182/3 |
| 4,767,091 | A * | 8/1988 | Cuny | 248/228.4 |
| 4,928,789 | A * | 5/1990 | Claeys | 182/3 |
| 4,928,790 | A * | 5/1990 | Franks | 182/3 |
| 5,029,670 | A * | 7/1991 | Whitmer | 182/113 |
| 5,092,426 | A * | 3/1992 | Rhodes | 182/3 |
| 5,325,788 | A * | 7/1994 | Strickland et al. | 104/119 |
| 5,711,397 | A * | 1/1998 | Flora et al. | 182/3 |
| 6,053,279 | A * | 4/2000 | McKenna | 182/36 |
| 6,092,623 | A * | 7/2000 | Collavino | 182/3 |
| 6,233,877 | B1 * | 5/2001 | Monroe | 52/37 |
| D459,839 | S * | 7/2002 | Blackford | D29/124 |
| 6,874,741 | B2 * | 4/2005 | Mirsberger et al. | 248/228.3 |
| 6,962,234 | B1 * | 11/2005 | Reeves | 182/36 |
| 7,000,730 | B1 * | 2/2006 | Ostrobrod | 182/36 |
| 7,111,707 | B2 * | 9/2006 | Reeves | 182/36 |
| 8,096,384 | B2 * | 1/2012 | Caylor et al. | 182/3 |
| 8,181,740 | B2 * | 5/2012 | Blomberg et al. | 182/36 |

(Continued)

FOREIGN PATENT DOCUMENTS

DE 4001724 A1 * 7/1991

OTHER PUBLICATIONS

Sharpe Safety Supply, Inc., Model 1700 Adjustable Sliding Beam Anchor, web page at "http:/www.sharpesafety.com/catalog/product-display.php3?ID=1145", publication date unknown.

(Continued)

*Primary Examiner* — Kimberly Wood
(74) *Attorney, Agent, or Firm* — Portland Intellectual Property, LLC

(57) ABSTRACT

A beam anchor. The beam anchor is generally used for attaching to a flanged beam that has been made a part of a structure, to provide fall protection for a worker working on the structure. The beam anchor includes a main cross-member with a beam capturing member at each end. One or both of the capturing members have associated therewith respective yaw restoring mechanisms providing a combined restoring torque for urging the cross-member in counteraction to twisting thereof by a yaw angle in a yaw plane that is substantially parallel to the surface portions. Preferably, a lanyard attachment member is slidably disposed on the cross-member and spring-biased into a relatively centered position between the capturing members.

24 Claims, 6 Drawing Sheets

U.S. PATENT DOCUMENTS

| | | | | |
|---|---|---|---|---|
| 2004/0195479 | A1* | 10/2004 | Gulley | 248/228.1 |
| 2007/0163834 | A1* | 7/2007 | Casebolt | 182/3 |
| 2011/0155505 | A1* | 6/2011 | Liang | 182/3 |

OTHER PUBLICATIONS

Sharpe Safety Supply, Inc., Miller® Shadow Beam Anchor, web page at "http//www.sharpesafety.com/catalog/product-display.php3?ID=1247", publication date unknown.

Sharpe Safety Supply, Inc., Beamer 2000 Beam Anchor, web at "http://wwwsharpesafety.com/catalog/product-display.php3?ID=844", publication date unknown.

Drillspot, Model 2104700 Sliding I-Beam Anchor, web page at "http:www.drillspot.com/products/943380/dbi_sala-capital safety-2104700 sliding i-beam anchor?s=1", publication date unknown.

Urbanart, Beam Anchors and D-Ring Anchors, web page at "http://www.urbanart.com/shopsite/hardware_beamanchors.html", publication date unknown.

MSE Mechanical Safety Equipment Corporation, I-Beam Anchors, web at "http://www.msecorporation.com/main.asp?n=3&id=15", publication date unknown.

MSA, web at "http://www.msnorthamerica.com/catalog/product17445.html", publication date unknown.

* cited by examiner

Fig. 8
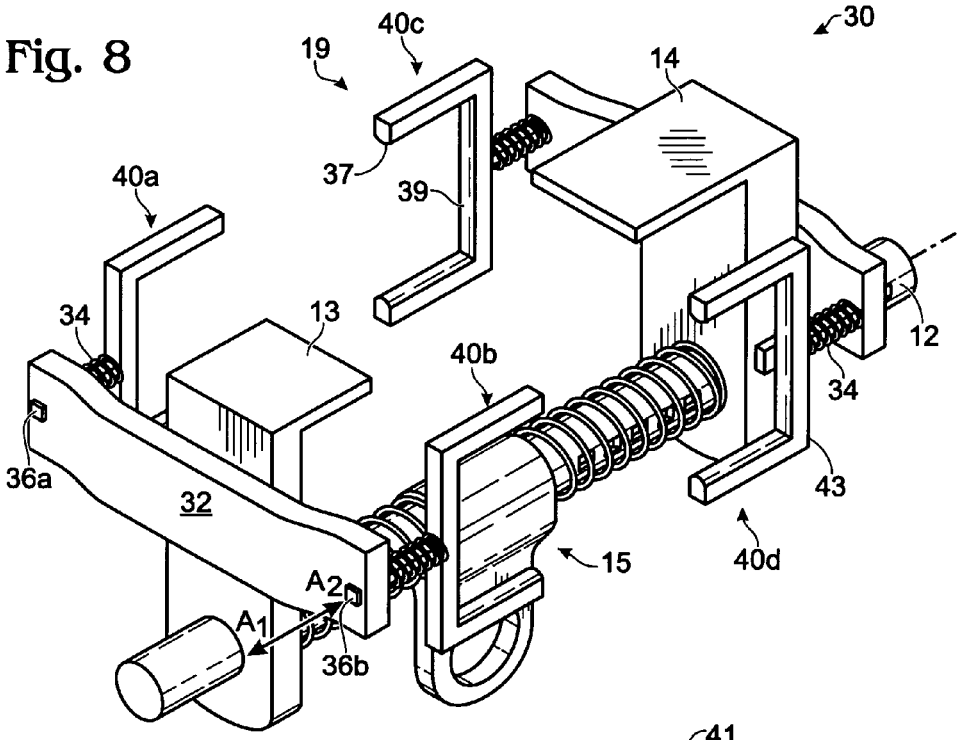
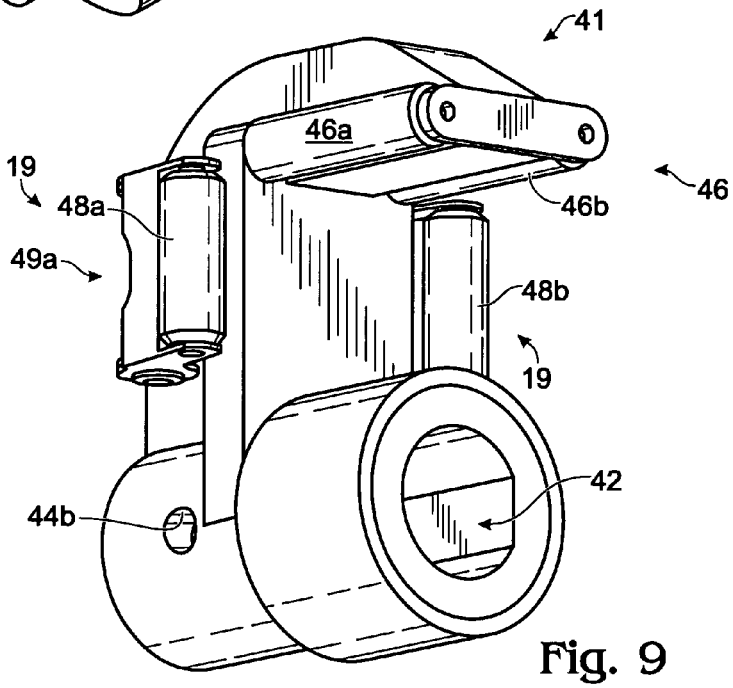
Fig. 9

BEAM ANCHOR

FIELD OF THE INVENTION

The present invention relates to the provision of fall protection in the form of an anchor for attaching to an I-beam or similar structure.

BACKGROUND

In the construction industry, it is always important, and it is often a requirement, to protect construction workers against falling from the structures they are constructing. Such "fall protection" is typically provided by equipping workers with harnesses attached by cables called "lanyards" to anchor points on the structure.

The need for fall protection in the case of high-rise structures is obvious, and a characteristic of such structures is the use of I-beams as structural members. Accordingly, a class of anchoring devices known as "beam anchors" has been provided specifically for utilizing I-beams as anchor points.

FIG. 1 shows a typical beam anchor 1. The beam anchor has a cross-bar 2 and a pair of I-beam capturing members 3, 4 at opposite ends of the cross-bar. The capturing members 3, 4 attach the cross-bar to an I-beam as discussed below in connection with FIG. 2.

A coupler 5 has a circular aperture "A" through which the hook of a lanyard can be attached. Typically, one of the I-beam capturing members 3 is fixedly attached to the cross-bar, while the position of the other capturing member 4 is adjustable along the length of the cross-bar, so that the spacing between the capturing members is adjustable to fit the varying widths of different sized I-beams. A number of different mechanisms may be used to adjust the position of the I-beam capturing member 4 and lock it in place.

For example, as shown in FIG. 1, a spring-biased detent mechanism may be provided that allows for locating the capturing member 4 in spaced increments. Detents "$D_1$" in the cross-bar 2 are shown, while the corresponding spring-biased activating mechanism "$D_2$" in the I-beam capturing member 4 is indicated schematically. Some other well known prior art mechanisms employ holes in the cross-bar and pins extending through the capturing member 4 into a selected one of the holes, or nuts threaded onto the cross-bar.

While it is known to be advantageous to dispose the coupler centrally with respect to the I-beam, so that the load is evenly distributed across the I-beam capturing members 3, 4, this objective has not been achieved in practice. Two approaches have been taken.

In the first approach, the coupler 5 has been fixedly attached to the cross-bar in a central location of the cross-bar relative to the capturing members 3 and 4. However, when one of the capturing members 3, 4 is moved relative to the cross-bar while the position of the other remains fixed, the central location changes. Then, the fixed position of the coupler 5 is no longer a central location relative to the I-beam. Accordingly, the position of the coupler 5 is chosen as a compromise.

In the second approach, the coupler 5 is allowed to slide freely along the cross-bar, thus permitting the coupler 5 to assume the ideal, central location, regardless of the spacing between the capturing members. However, the coupler is also able to slide out of this position.

The problem is avoided if both I-beam capturing members are adjustable and moved the same amount (in opposite directions); however, this requires a more complex and costly device that is more difficult to use.

Another problem with the beam anchor can best be appreciated with reference to FIG. 2, showing a beam anchor attached to an I-beam. The I-beam has a center section 6 whose primary function is to support two spaced-apart flanges 7, 8 which carry the bulk of the bending load. The beam anchor rides on one of the flanges, here the flange 7, in and out of (i.e., perpendicular to) the plane of the Figure. More particularly, over-hanging portions 3*a*, 4*a* of the capturing members 3, 4 slide on the upper surface 7*a* of the flange 7. By riding the flange, the beam anchor can follow the worker as the worker moves along the I-beam.

The capturing members 3, 4 are adjusted as described above to fit the width "W" of the flange 7. There remains a gap "g" between each capturing member 3, 4, and the flange 7 to allow the beam anchor to move without substantial frictional interference with the edges 9 (specifically shown as 9*a*, 9*b*) of the flange. However, as a consequence of this gap, the beam anchor 1 is susceptible to twisting about the vertical axis "$L_1$," i.e. in the plane perpendicular to the plane of the Figure, as it is moved along the length of the I-beam. Referring in addition to FIG. 3, when the beam anchor twists (or rotates) about the axis L by an increasing angle θ, the distance "d" between the capturing members as shown in FIG. 2 becomes less able to span the width "W" of the beam, until d multiplied by cosine (θ) is reduced to the point of equaling W, whereupon an interference is established between the capturing members 3, 4 and the flange, with the result that the beam anchor binds on the I-beam. The worker must then take the time and make the effort to apply a significant impact force to the anchor beam to dislodge or free the anchor beam from the I-beam, and thereby re-establish the mobility of the beam.

SUMMARY

A beam anchor is disclosed herein. The beam anchor is generally used for attaching to a flanged beam that has been made a part of a structure, to provide fall protection for a worker working on the structure. The flanged beam generally has at least one flange having two, opposed and typically relatively short side edge surfaces that are substantially vertically oriented and that terminate in corresponding, substantially horizontally oriented and typically relatively large, surface portions.

According to one aspect of the invention, the beam anchor has an elongate main cross-member, a pair of first and second, spaced apart beam capturing members attached to the main cross-member, a lanyard attachment member, and one or springs. The capturing members are attached to the main cross-member in such manner that the spacing between the capturing members is adjustable. The capturing members are adapted to over-hang, respectively, the surface portions, and are thereby enabled to hang the main cross-member therefrom. The lanyard attachment member is slidably disposed on the main cross-member. The one or more springs are adapted to maintain a relatively centered position of said attachment member between said beam capturing members.

According to another aspect of the invention, which is preferably though not necessarily provided with the slidably mounted lanyard attachment member and the one or more springs described above, one or both of the capturing members have associated therewith respective yaw restoring mechanisms providing a combined restoring torque for urging the cross-member in counteraction to twisting thereof by a yaw angle in a yaw plane that is substantially parallel to the surface portions. The yaw restoring mechanism or mechanisms are adapted to contact portions of the corresponding side edge surfaces of the flange to apply the restoring torque.

For yaw angles between about 10-30 degrees, the restoring torque is preferably between about 1-200 inch-pounds.

Preferably, either one or both of the following features are provided in combination with the above: (1) the yaw restoring mechanism or mechanisms are adapted to contact the portions of the corresponding side edge surfaces of the flange so that the capturing members are each pushed away from the beam with a force that is greater than about 0.5 pound when the yaw angle is zero; (2) the yaw restoring mechanism or mechanisms are adapted to present convexly curved surfaces of contact with the side edge surfaces of the flange.

Preferably, the yaw restoring mechanism or mechanisms include respective springs of one or more of the types (a) wire form; and (b) flat form.

It is to be understood that this summary is provided as a means of generally determining what follows in the drawings and detailed description and is not intended to limit the scope of the invention. Objects, features and advantages of the invention will be readily understood upon consideration of the following detailed description taken in conjunction with the accompanying drawings.

BRIEF DESCRIPTION OF THE DRAWINGS

FIG. 8 is an isometric view of an alternative beam anchor according to the present invention.

FIG. 9 is a three-dimensional view of an alternative capturing member according to the invention, showing one side thereof.

DETAILED DESCRIPTION OF PREFERRED EMBODIMENTS

Figure 4:
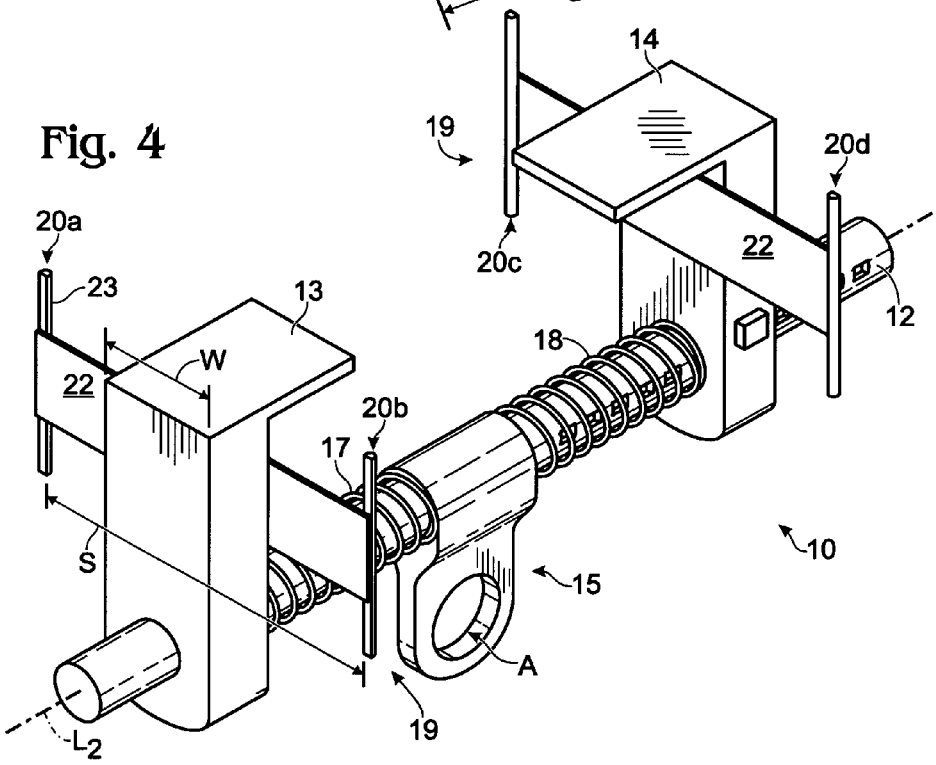
FIG. 4 is an isometric view of a beam anchor according to the present invention.

FIG. 4 shows a first embodiment 10 of a beam anchor according to the present invention. The beam anchor 10 attaches to an exposed I-beam, and provides the novel feature of riding on a flange thereof, providing a translatable anchoring point to which a flexible tensile member, such as a rope, cable or chain, may be attached, to provide fall protection for a construction worker. The beam anchor 10 must be strong enough, not only to support the static weight, but to break the fall of a 310 pound person (weight including tools). More specifically, beam anchors according to the invention preferably meet or exceed ANSI standard Z359.1, specifying that the anchor must withstand, without breaking, at least 5000 pounds force.

The beam anchor 10 has a cross-bar 12 and a pair of I-beam capturing members 13, 14 at opposite ends of the cross-bar. A lanyard attachment member or coupler 15 has an aperture "A" through which the hook of a lanyard can be attached. The capturing members 13, 14 ride the flange 7 in the manner described above.

In the beam anchor 10, one of the I-beam capturing members 13 is fixedly attached to the cross-bar, while the position of the other capturing member 14 is adjustable along the length of the cross-bar (i.e., "adjustable"). Alternatively, both capturing members may be adjustable, in this and other embodiments.

The spring-biased detent mechanism described above may be utilized in the beam anchor 10, but any standard adjustment mechanism allowing for adjustment of the axial location, along the length of the cross-bar 12 (axis "$L_2$"), of one or more of the capturing members 13, 14, and for locking the one or more capturing members in the selected location(s), could be utilized as well.

Figure 1:
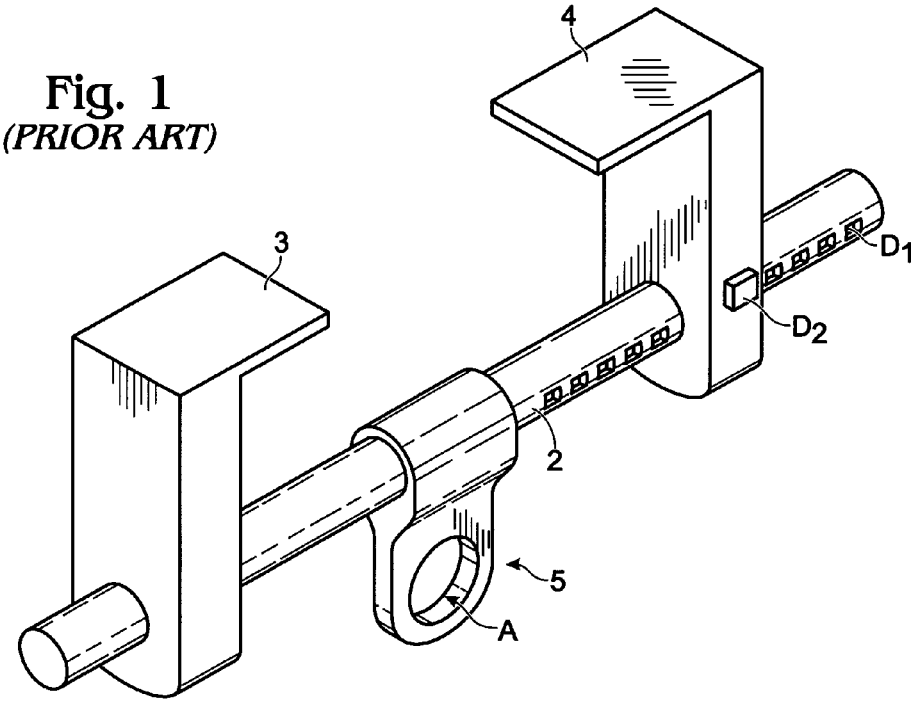
Fig. 1 (PRIOR ART)
FIG. 1 is an isometric view of a prior art beam anchor.

According to the invention, the coupler 15 is preferably spring-biased to address the centering problem discussed above in connection with FIG. 1; particularly to facilitate maintenance of the coupler 15 in a central position relative to the I-beam capturing members 13, 14. This is considered desirable regardless of whether just one of the I-beam capturing members is adjustable as in the beam anchor 10, or whether both I-beam capturing members are adjustable. A number of spring-biasing configurations may be used.

FIG. 4 shows one example wherein the coupler 15 is simply disposed between a pair of coiled compression springs 17, 18, coaxially surrounding the cross-bar 12. Each spring 17, 18, resists, by compressing, excursions of the coupler 15 in the direction thereof. Preferably, where there are two springs such as in this example, the springs are substantially identical, so that the restoring force is substantially the same for restoring stray movements of the coupler in either direction along the cross-bar.

The springs 17, 18 could alternatively be adapted to provide tensile restoring forces. For example, one end of each spring could be tied to the respective capturing member (or some other desired reference or attachment point), with the other end of the spring tied to the opposite side of the coupler.

The springs 17, 18 could be replaced with a single coil spring acting in both compression and tension. For example, one end of a single spring may be tied to one of the capturing members 13, 14 with the other end of the spring tied to the coupler 15. The spring resists compression when the coupler is displaced in a direction toward the spring, and resists extension when the coupler is displaced in the opposite direction. Alternatively, the two ends of the spring may be tied, respectively, to the capturing members 13, 14, with the coupler 15 being tied to the spring relatively mid-way along its length.

Other spring configurations can also be used. For example, one or more leaf springs could be used with suitable adaptations being made to the beam anchor 10.

With continued reference to FIG. 4, a yaw restoring mechanism 19 according to the invention is preferably provided to address the binding problem discussed above in connection with FIGS. 2 and 3; particularly, that beam anchors twist and often jamb against the I-beam as a result of the (necessary) play between the capturing members and the edges of the I-beam flange.

The yaw restoring mechanism 19 includes at least one pair of spaced-apart, spring-biased outriggers 20 supported by one of the I-beam capturing members 13, 14, and preferably includes two such pairs supported, respectively, by both I-beam capturing members. In the latter case, which is shown in FIG. 4, the capturing member 13 supports the outrigger pair 20*a*, 20*b*, and the capturing member 14 supports the outrigger pair 20*c*, 20*d*. The outrigger pairs are preferably identical, and are therefore described below with arbitrary reference to the pair 20*a*, 20*b* associated with the capturing member 13. However, it is not essential that the outrigger pairs be identical.

The outriggers 20*a*, 20*b* are connected to opposite ends of a leaf spring 22, supported by the capturing member 13. An outrigger 20 is preferably positioned on each of the two opposite sides of the capturing member, the leaf spring 22 preferably extends perpendicular to the axis $L_2$, and the outriggers are preferably symmetrically disposed about the axis $L_2$, though none of these conditions is essential. The preferred spacing "S" between the outriggers is about 4-5"; the maximum spacing should be about 12"; and the width "w" of the capturing member sets a practical lower limit on the spacing between the outriggers.

Figure 5:
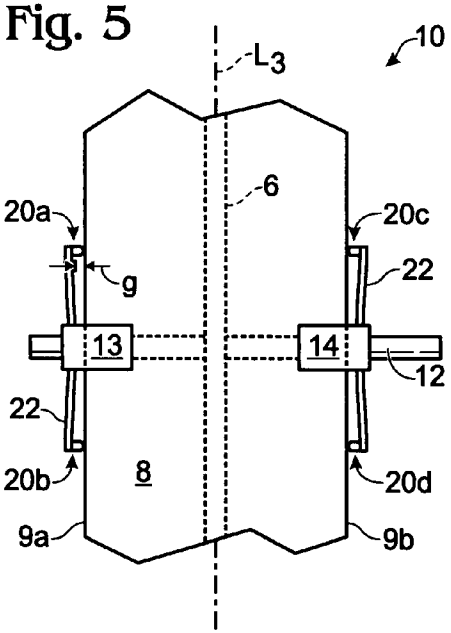
FIG. 5 is a plan, cut-away view of the beam anchor of FIG. 3 attached to an I-beam.

The leaf spring 22 spring-biases both outriggers 20*a*, 20*b* toward the edges 9 of the I-beam flange, so that the outriggers make contact with the edges 9 as indicated in FIG. 5. On the other hand, the I-beam capturing members are spaced from the edges 9 by a gap "g," as explained above, sufficient to permit the beam anchor to slide along the I-beam, along the axis "$L_3$." In the preferred embodiment in which a spring-biased detent mechanism is used, the detents are typically spaced apart by about 0.5", and in such case the gap "g" must be at least 0.5", i.e., the gap "g" cannot as a practical matter be smaller than the spacing between detents.

Figure 6:
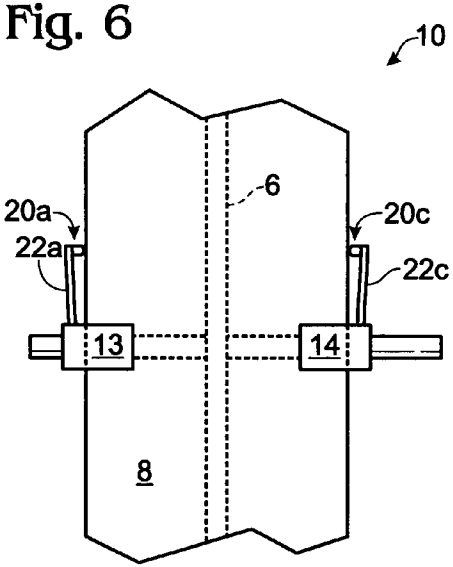
FIG. 6 is a plan, cut-away view of a modified beam anchor according to the present invention attached to an I-beam.

Referring to FIG. 6, while not preferred, it is possible to provide a single outrigger 20*a*, instead of the pair 20*a*, 20*b*, on the capturing member 13. In such case it would be more preferred to also include at least another single outrigger 20*c* on the capturing member 14. The outriggers 20*a*, 20*c* as shown are connected to the capturing members by respective leaf springs 22*a*, 22*c* that are about half the length of the leaf spring 22.

Figure 7:
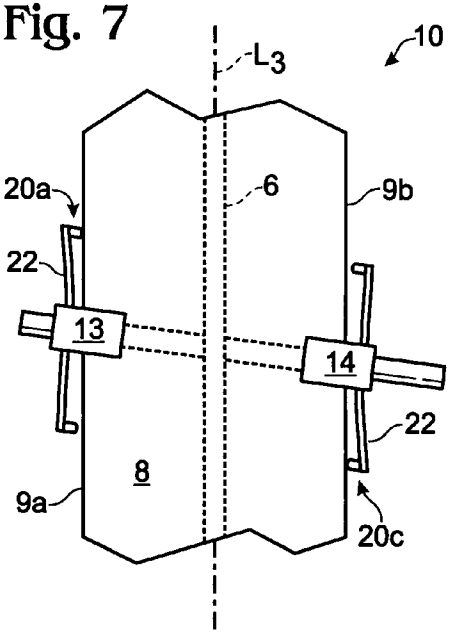
FIG. 7 is a plan, cut-away view of the beam anchor of FIG. 3 with the beam anchor twisted in a yaw plane relative to the I-beam.

Turning to FIG. 7, if the beam anchor 10 is twisted in a yaw plane "P" (e.g., the plane of the paper) relative to its position in FIG. 5, the springs 22 flex at the outriggers 20*a* and 20*d*, providing restoring forces in reaction, tending to maintain alignment of the cross-bar 12 perpendicular to the elongate axis $L_3$ of the I-beam.

Providing the same yaw restoring function, an alternative embodiment 30 of a beam anchor according to the invention is shown in FIG. 8. The capturing member 13 supports, in this case, an outrigger pair 40*a*, 40*b*, and the capturing member 14 supports a corresponding outrigger pair 40*c*, 40*d*. The outrigger pairs are preferably identical, and are therefore described below with arbitrary reference to the pair 40*a*, 40*b* associated with the capturing member 13. However, it is not essential that the outrigger pairs be identical.

The beam anchor 30 illustrates some variations, that can be provided separately or in combination, relative to the beam anchor 10. One of these is that the beam anchor 30 utilizes coiled springs instead of leaf springs. The coiled springs can be utilized in compression, as shown in FIG. 8, or they can be used in tension with suitable modification as will be readily appreciated in view of the discussion above in connection with the spring-biasing of the coupler.

The outriggers 40*a*, 40*b* are connected to opposite ends of a "rigid" minor cross-member or bar 32, the bar 32 being rigid in that it deflects a small amount (less than 10%) as compared to the coiled springs, and therefore provides a relatively small or negligible spring-biasing function. Instead, the outriggers 40*a*, 40*b* are spring-biased by respective coil springs 34 acting against the bar 32. Alternatively, the bar 32 may, equivalent to the leaf springs 22 in the beam anchor 10, provide a spring-biasing function in combination with that provided by the coiled springs.

Another of the variations exemplified in the beam anchor 30 is that the outriggers 40*a*, 40*b* are configured in a "C" shape ("C configuration"), which helps ensure that the outriggers remain true to the flange 8 (FIG. 2) during use, by partially surrounding the corresponding edges of the flange, both over-hanging the substantially horizontal surfaces flange 7*a* and 7*b* (FIG. 2), and under-hanging the corresponding surfaces 7*c* and 7*d*. Alternatively, the outriggers could be configured in an "L" shape, which could be inverted or not ("L configuration"), in which, as suggested by the nomenclature, one of the arms of the "C" configured outriggers (e.g., 37 of 40*c*) is not present. At least a portion of the outrigger(s) in either configuration extend, in use, past the edges 9 of the flange, and therefore extend inwardly (toward the coupler 15) relative to flange edge contacting surfaces 43 in the direction of the axis indicated by the line $A_1$-$A_2$ in FIG. 8. Hereinafter, any configuration providing such functionality is referred to as a "beam surrounding configuration."

The outriggers 40 are slidably attached to respective ends of the bar 32 so that they can slide in the directions $A_1$-$A_2$. The coil springs 34 spring-bias the outriggers 40*a*, 40*b* in the direction $A_2$, whereas the outriggers 40*c*, 40*d* are biased in the direction $A_1$.

The outriggers 40*a*, 40*b* are slidably attached to the bar 32 by arms 36*a*, 36*b* respectively. The arms 36 are preferably non-cylindrical, such as by being square or rectangular in cross-section as indicated, to allow the outriggers to slide relative to the bar 32 without rotating.

Preferably, the bars 32 are provided out-board of the capturing members 13 and 14 in the embodiment 30 as shown in FIG. 8, rather than in-board as are the leaf springs in the embodiment 10 shown in corresponding FIG. 4. This is simply to minimize the required depth of the capturing members 13 and is not essential.

Other spring configurations employing more or fewer springs could be utilized. For example, by analogy to the leaf spring alternative mentioned above in connection with the beam anchor 10, the beam anchor 30 could employ a single coil spring that, through use of an intermediating structure, applies force to both outriggers 40*a*, 40*b*. Also, the capability of utilizing single outriggers instead of pairs in the beam anchor 30 mirrors that of the beam anchor 10 as described above.

The outriggers are preferably formed of, or at least have flange edge contacting surfaces (e.g., surface 23 in FIG. 4; surface 43 in FIG. 8) that are formed of, a polymeric material having a high lubricity, to minimize friction during contact with the edges 9 of the flange. For example, the outriggers themselves or the indicated surfaces thereof may be formed of a high density polyethylene. In addition, the surfaces are preferably convexly curved, such as indicated in FIGS. 4 (see, e.g., 23 of 20*a*) and 8 (see, e.g., 37 and 39 of 40*c*), so that the areas of contact between these surfaces and the flange are minimized which also reduces friction, but neither of these features is essential.

Figure 10:
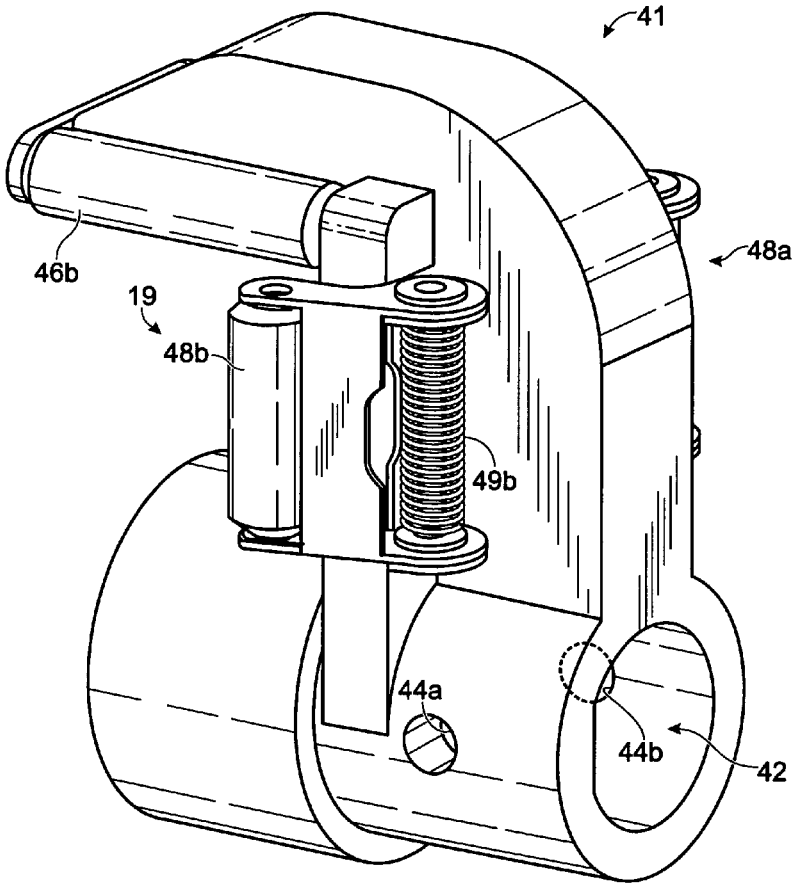
FIG. 10 is another three-dimensional view of the capturing member of FIG. 9, showing the other side.
Figure 11:
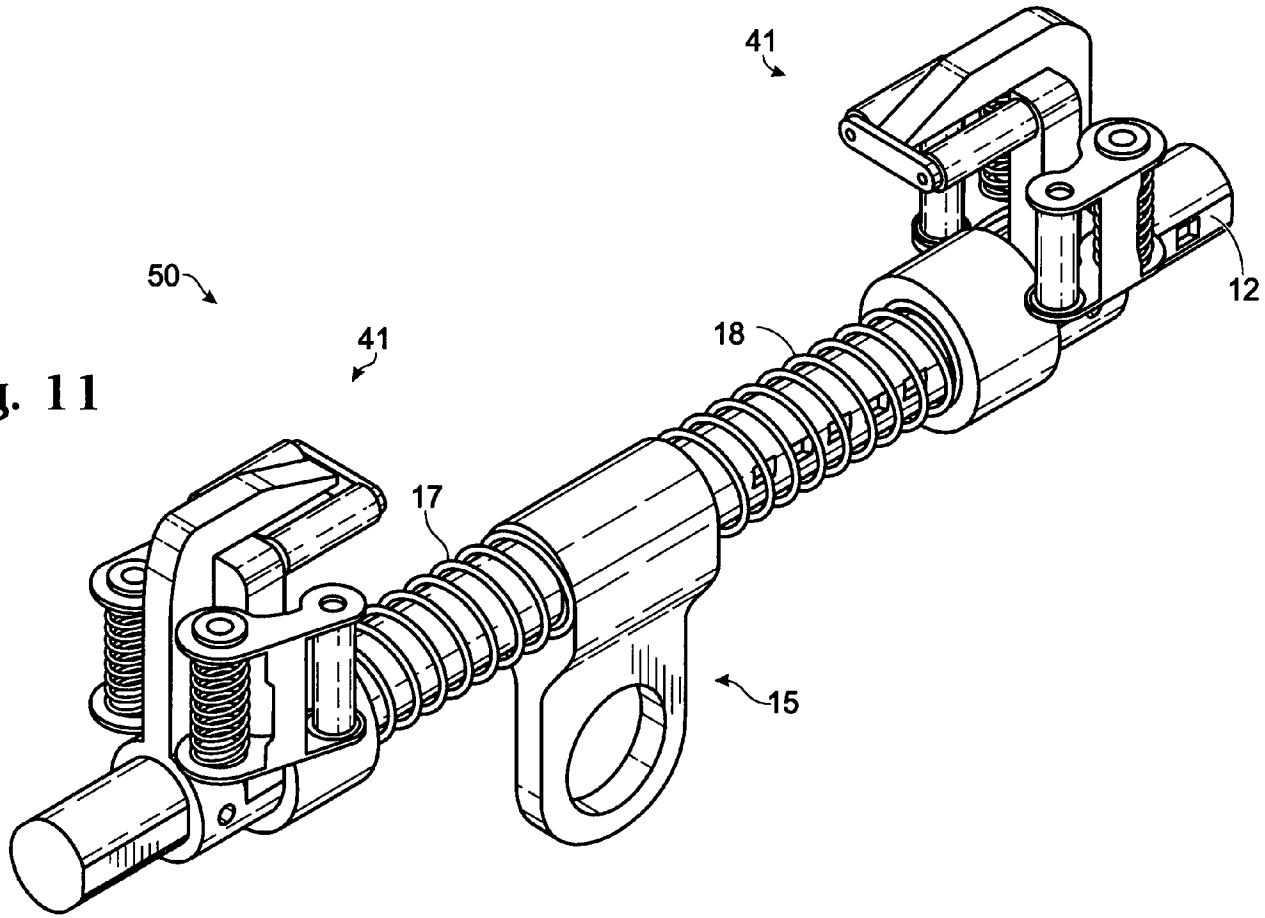
FIG. 11 is an isometric view of another alternative beam anchor according to the present invention.

FIGS. 9 and 10 show an alternative capturing member 41 according to the invention, and FIG. 11 shows an alternative beam anchor 50 employing the capturing member 41. The beam anchor 50 is shown according to the example of FIG. 4, therefor including the springs 17 and 18 and the capturing member 15 described previously. The capturing member 41 receives the cross-bar 12 through an aperture 42, and can be fixed to the cross-bar in any number of ways, such as with a pin passing through the cross-bar 12 and through holes 44*a*, 44*b*. Also, the capturing member as shown may easily be adapted for adjustable positioning as described above and as will be readily appreciated by persons of ordinary skill.

Preferably, the capturing member 41 provides for riding the flange with less resistance due to the provision of one or more rollers 46 (two rollers are shown, as 46*a* and 46*b*) that make contact with the top surface(s) 7*a*, 7*b* of the flange 7 (FIG. 2), and roll on these surfaces rather than slide across the surfaces as in the aforedescribed embodiments. However, the rollers 46 need not actually be adapted to rotate or roll, and they could be replaced with other static forms for making contact with the surface(s) 7*a*, 7*b*. An example of such a static form is that utilized within the C configuration of the capturing members 40, of the embodiment 30 shown in FIG. 8, particularly that associated with the upper, over-hanging portion (e.g., 37 of the outrigger 40*c*) thereof.

The capturing member 41 includes an alternative yaw restoring mechanism 42 that also employs one or more rollers, preferably two rollers 48*a* and 48*b* disposed on opposite sides of the capturing member 41, corresponding to the outriggers 20*a*, 20*b* described above in connection with FIG. 4, i.e., each roller corresponds to an outrigger and provides the same function.

The rollers 48*a* and 48*b* make contact with the edge(s) 9*a*, 9*b* of the flange 7 (FIG. 2), providing a rolling surface corresponding to the surface 23 (FIG. 4). However, the rollers 48 need not actually be adapted to rotate or roll, and they could be replaced with other static forms for making contact with the edge(s) 9. An example of such a static form is that utilized within the C configuration of the capturing members 40, of the embodiment 30 shown in FIG. 8, particularly that associated with the vertically disposed portion (e.g., 39 of the outrigger 40*c*) thereof.

Respective coiled (or helical) torsion springs 49*a*, 49*b* (49*a* not visible) may be used to bias the rollers toward the edges, and correspond to half of the leaf spring 22 of FIG. 4 (e.g., 22*a* in FIG. 6).

All of the aforedescribed embodiments can utilize springs of various types to provide the yaw restoring and coupler centering functions. Any type of spring, or combination of springs could be utilized, and the features of the different embodiments can be mixed and matched with regard to the type of spring used as well as with regard to the other aspects thereof. While leaf springs, coiled springs in either tension or compression, and coiled torsion springs have all been noted above, it should be noted that other types of springs could also be used. For example, stacked "wave spring washers" could be used to replace the coiled springs of the beam anchor 30. Generally, springs are considered for purposes herein to be either wire form springs, which include but are not limited to coiled and helical springs, and flat form springs, which include but are not limited to leaf springs and wave springs.

Figure 2:
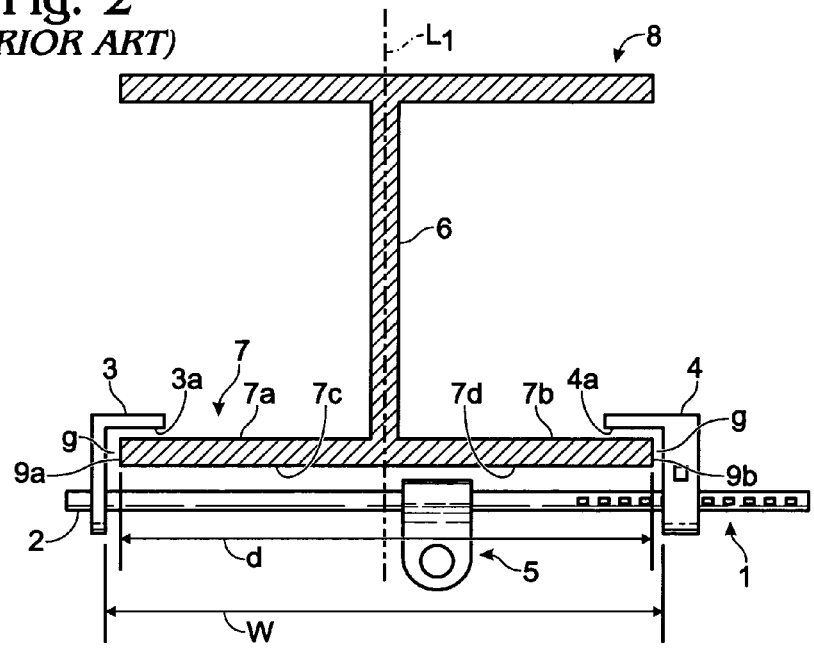
Fig. 2 (PRIOR ART)
FIG. 2 is a side elevation view of the beam anchor of FIG. 1 attached to an I-beam.
Figure 3:
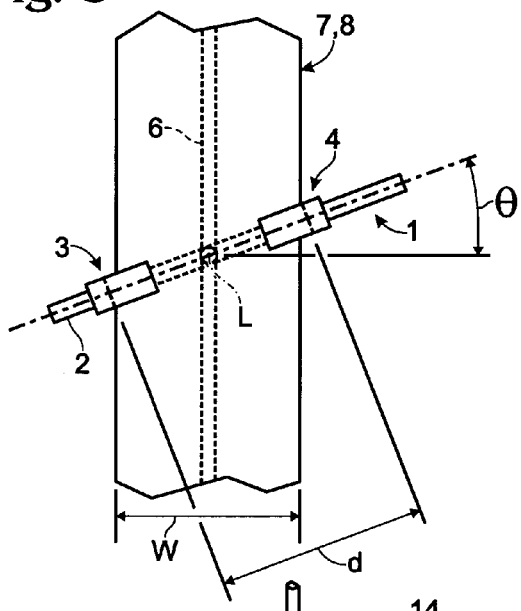
FIG. 3 is a plan view of the beam anchor of FIG. 2.

Also as will be readily apparent to persons of ordinary mechanical skill, the spring-bias required to effectively counteract the tendency for the beam anchor to bind during use depends on a number of factors, an important one of which is the amount of leverage being applied by the yaw restoring mechanisms, and another being the amount of twist that can be permitted, which depends on the size of the gap "g." However, it can be generally stated that, regardless of the number and type of springs used in the yaw restoring mechanisms, and regardless of how the springs and/or the yaw restoring mechanisms and their various features are mixed and matched, the beam anchor should provide a combined restoring torque, for resisting twisting of the beam anchor by a yaw angle θ in a yaw plane that is substantially perpendicular to the axis $L_1$ in FIG. 2, or equivalently substantially parallel to the surfaces 7*a*, 7*b*, 7*c*, and 7*d*, that is preferably in the range of 0.1-6.7 inch-pounds/degree; still more preferably 0.5-3.3 inch-pounds/degree; yet more preferably 1.0-2.0 inch-pounds/degree; and most preferably about 1.5 inch-pounds/degree which corresponds to a restoring torque at a 20 degree yaw angle of 30 inch-pounds. While spring rates (force/deflection) are generally constant, this is not essential. For yaw angles between 10-30 degrees in either direction (positive or negative angle θ), the restoring torque provided by any of the beam anchor embodiments is preferably between about 1-200 inch-pounds, more preferably 5-100 inch-pounds, more preferably 10-60 inch-pounds, and most preferably 15-45 inch-pounds which, again, corresponds to a restoring torque at a 20 degree yaw angle of 30 inch-pounds.

Also, preferably, the spring or springs force the capturing members outwardly, away from the I-beam, with a force (on each capturing member) of at least 0.5 pounds at a zero yaw angle, providing a pre-load such as indicated, e.g., in FIG. 5.

It is to be understood that, while a specific beam anchor has been shown and described as preferred, other configurations and methods could be utilized, in addition to those already mentioned, without departing from the principles of the invention. It should also be recognized that beam anchors according to the invention may be used to attach to any flanged beam, or any beam whether flanged or not, or any equivalent structure to which it is capable of being attached and utilized according to the principles described herein, an I-beam simply being the most common example of such structures.

The terms and expressions which have been employed in the foregoing specification are used therein as terms of description and not of limitation, and there is no intention in the use of such terms and expressions to exclude equivalents of the features shown and described or portions thereof, it being recognized that the scope of the invention is defined and limited only by the claims which follow.

The invention claimed is:

1. A beam anchor for attaching to a flanged beam that has been made a part of a structure, to provide fall protection for a worker working on the structure, the flanged beam having at least one flange having two, opposed side edge surfaces that are substantially vertically oriented and that terminate in corresponding, substantially horizontally oriented surface portions of the flange, the beam anchor comprising:

a main cross-member supporting a lanyard attachment member having a through-hole for attaching a lanyard;

a pair of first and second, spaced apart beam capturing members attached to said main cross-member in such manner that the spacing between said capturing members is adjustable, said capturing members being adapted to over-hang, respectively, the surface portions, and are thereby enabled to hang said main cross-member therefrom, wherein one or both of said capturing members have associated therewith respective yaw restoring mechanisms providing a combined restoring torque for urging the cross-member in counteraction to twisting thereof by a yaw angle in a yaw plane that is substantially parallel to the surface portions, wherein said yaw restoring mechanism or mechanisms are adapted to contact portions of the corresponding side edge surfaces of the flange to apply said restoring torque, wherein said restoring torque, for yaw angles between about 10-30 degrees, is between about 1-200 inch-pounds.

2. The beam anchor of claim 1, wherein said yaw restoring mechanism or mechanisms are adapted to contact said portions of the corresponding side edge surfaces of the flange so that said capturing members are each pushed away from the beam with a force that is greater than about 0.5 pound when said yaw angle is zero.

3. The beam anchor of claim 2, wherein said yaw restoring mechanism or mechanisms are adapted to present convexly curved surfaces of contact with the side edge surfaces of the flange.

4. The beam anchor of claim 1, wherein said yaw restoring mechanism or mechanisms are adapted to present convexly curved surfaces of contact with the side edge surfaces of the flange.

5. The beam anchor of claim 1, wherein said yaw restoring mechanism or mechanisms include respective springs, said springs being one or more of (a) wire form, and (b) flat form.

6. The beam anchor of claim 5, the beam having an elongate axis and opposite ends defining proximal and distal directions along the axis, wherein there are at least two of said yaw restoring mechanisms, at least a first one of said yaw restoring mechanisms being associated with a first one of said capturing members and at least a second one of said yaw restoring mechanisms being associated with the second one of said capturing members, said first and second yaw restoring mechanisms having respective proximally extending leverage-applying members adapted for maintaining or contributing to the maintenance of said contact.

7. The beam anchor of claim 6, wherein said proximally extending leverage-applying members each include a respective spring, one end of said spring being attached or supported by the associated capturing member and another end of said spring carrying a contacting member for maintaining or contributing to the maintenance of said contact.

8. The beam anchor of claim 7, wherein said contacting members include respective convexly curved surfaces for maintaining or contributing to the maintenance of said contact.

9. The beam anchor of claim 8, wherein said contacting members include respective rolling members, for rolling on said portions of the corresponding side edge surfaces of the flange.

10. The beam anchor of claim 8, wherein said contacting members have beam surrounding configurations.

11. The beam anchor of claim 7, wherein said contacting members have beam surrounding configurations.

12. The beam anchor of claim 11, wherein said lanyard attachment member is slidably disposed on said main cross-member, further comprising one or more springs adapted to maintain a relatively centered position of said attachment member between said beam capturing members.

13. The beam anchor of claim 10, wherein said lanyard attachment member is slidably disposed on said main cross-member, further comprising one or more springs adapted to maintain a relatively centered position of said attachment member between said beam capturing members.

14. The beam anchor of claim 9, wherein said lanyard attachment member is slidably disposed on said main cross-member, further comprising one or more springs adapted to maintain a relatively centered position of said attachment member between said beam capturing members.

15. The beam anchor of claim 8, wherein said lanyard attachment member is slidably disposed on said main cross-member, further comprising one or more springs adapted to maintain a relatively centered position of said attachment member between said beam capturing members.

16. The beam anchor of claim 7, wherein said lanyard attachment member is slidably disposed on said main cross-member, further comprising one or more springs adapted to maintain a relatively centered position of said attachment member between said beam capturing members.

17. The beam anchor of claim 6, wherein said lanyard attachment member is slidably disposed on said main cross-member, further comprising one or more springs adapted to maintain a relatively centered position of said attachment member between said beam capturing members.

18. The beam anchor of claim 5, wherein said lanyard attachment member is slidably disposed on said main cross-member, further comprising one or more springs adapted to maintain a relatively centered position of said attachment member between said beam capturing members.

19. The beam anchor of claim 4, wherein said lanyard attachment member is slidably disposed on said main cross-member, further comprising one or more springs adapted to maintain a relatively centered position of said attachment member between said beam capturing members.

20. The beam anchor of claim 3, wherein said lanyard attachment member is slidably disposed on said main cross-member, further comprising one or more springs adapted to maintain a relatively centered position of said attachment member between said beam capturing members.

21. The beam anchor of claim 2, wherein said lanyard attachment member is slidably disposed on said main cross-member, further comprising one or more springs adapted to maintain a relatively centered position of said attachment member between said beam capturing members.

22. The beam anchor of claim 1, wherein said lanyard attachment member is slidably disposed on said main cross-member, further comprising one or more springs adapted to maintain a relatively centered position of said attachment member between said beam capturing members.

23. A beam anchor for attaching to a flanged beam that has been made a part of a structure, to provide fall protection for a worker working on the structure, the flanged beam having at least one flange having two, opposed side edge surfaces that are substantially vertically oriented and that terminate in corresponding, substantially horizontally oriented surface portions of the flange, the beam anchor comprising:

an elongate main cross-member;

a pair of first and second, spaced apart beam capturing members attached to said main cross-member in such manner that the spacing between said capturing members is adjustable, said capturing members being adapted to over-hang, respectively, the surface portions, and are thereby enabled to hang said main cross-member therefrom;

a lanyard attachment member slidably disposed on said main cross-member; and one or more springs adapted to maintain a relatively centered position of said attachment member between said beam capturing members.

24. The beam anchor of claim 23, wherein there are two of said springs, and wherein said springs are coiled compression springs, coaxially disposed about said cross-member on opposite sides of said attachment member.

* * * * *